United States Patent [19]

Horie

[11] 4,024,838

[45] May 24, 1977

[54] DEVELOPER LIQUID SUPPLYING DEVICE

[75] Inventor: Kiyoshi Horie, Ebina, Japan

[73] Assignee: Rank Xerox Ltd., London, England

[22] Filed: May 7, 1976

[21] Appl. No.: 684,204

[52] U.S. Cl. ..... 118/661; 427/15; 355/10; 118/DIG. 23

[51] Int. Cl.[2] ..... G03G 15/06

[58] Field of Search ..... 118/637, DIG. 23; 427/15; 355/10; 96/1 LY

[56] References Cited

UNITED STATES PATENTS

| | | | |
|---|---|---|---|
| 3,667,428 | 6/1972 | Smith | 118/DIG. 23 |
| 3,830,199 | 8/1974 | Saito et al. | 118/DIG. 23 |
| 3,974,554 | 8/1976 | Fantuzzo | 118/637 |
| 3,978,817 | 9/1976 | Hauser et al. | 118/637 |
| 3,980,404 | 9/1976 | Townsend | 118/DIG. 23 |

*Primary Examiner*—Henry S. Jaudon
*Attorney, Agent, or Firm*—James J. Ralabate; Ernest F. Chapman

[57] ABSTRACT

A resilient, patterned liquid developer applicator having raised and depressed areas for applying liquid developer to latent electrostatic images, is doctored by contacting it first with a squeegee roller to meter the depressed areas and subsequently with a relatively rigid raised area cleaning blade. The applicator has a resilient surface with a hardness of more than 60 Shore A and is provided with a plural number of finely divided discrete depressions and raised portions, and the squeegee doctor roller has a non-absorbing surface which has a hardness generally greater than the hardness of the surface of the applicator so that developer is squeezed from the depressions when the raised areas are deformed by the action of the squeegee roller.

13 Claims, 11 Drawing Figures

DEVELOPER LIQUID SUPPLYING DEVICE

BACKGROUND OF THE INVENTION

This invention relates generally to electrostatography, and more particularly it relates to improvements in developer liquid supplying devices in electrostatographic copying systems employing liquid development techniques.

In a known electrostatographic copying system a charge pattern is established on an imaging surface and is developed by a liquid development process wherein the liquid developer is presented to the charge pattern by an applicator or liquid supplying device which has a surface comprising raised areas or portions ("lands") and recessed portions or depressions ("valleys") adapted to contact liquid developer between or among the raised portions. The liquid developer is drawn to the imaging surface in image configuration by the electrostatic forces of the charge pattern.

Preferred methods and devices for the liquid development of electrostatic charge patterns are shown in U.S. Pat. No. 3,084,043 and U.S. Pat. No. 3,806,354. In these systems a developer liquid supplying member, generally an applicator roll, is utilized to present liquid developer to the surface of the member carrying the charge pattern. The applicator roll is normally prepared for coming into developing contact with the imaging surface by first contacting it with a doctoring or metering blade or other resilient or absorbent metering device or combinations thereof, in order to adjust the liquid in the valleys to a predetermined level and to clean the lands so that they are substantially free from liquid developer.

In the foregoing system a liquid developer supply member having on the surface thereof finely divided raised portions and depressions in a regular geometric pattern, is used to develop a latent image by the steps of supplying a liquid developer to the depressions of the developer supply member and bringing the raised portions of the developer supply member into contact with a latent image supporting member bearing an electrostatic latent image so as to cause the electrically conductive developer liquid retained in the depressions to creep up along the side of the raised portions by the attraction of the charges of the latent image into contact with the latent image. Undesirable amounts of liquid developer in the depressions results in the deposit of liquid developer in the background, and this is caused by the inability of the prior art metering devices both to meter the depth of the liquid developer at proper levels in the applicator valleys and to render the lands substantially clean. The volume of liquid developer which must be pushed aside by or absorbed by the prior art metering devices is frequently more than the device can handle and still clean the lands, or the absorbent type of metering device can only meter to the extent of its absorbing capacity without the use of additional means to clean liquid developer from the absorbing device. Furthermore, the absorbing type doctoring devices, even when used in conjunction with a resilient or rigid land cleaning member, tend to remove too much liquid developer from the depressions or too little liquid developer from the depressions or both, depending upon the absorbency of the absorbent material. Representative of these prior art devices are the disclosures in U.S. Pat. No. 3,830,199 and U.S. Pat. No. 3,667,428.

In the foregoing liquid development methods and devices there is also a risk of the surface of the latent image supporting member being damaged due to contact with the developer supplying member. In order to avoid this damage, liquid developer supplying members formed from a resilient, compressible electrically conductive material are used, and excess developer liquid supplied in the depressions is wiped or scraped therefrom by a doctor blade or similar member to leave a desired amount of developer in the depressions.

In these devices and methods, the liquid developer *c* remains within the depressions *b* of the liquid developer supplying member *a* after doctoring, and liquid developer does not adhere to the rigid raised portions *d*, that is, the position in which the level of the developer is maintained below peaks of the raised portions by a distance *l* as illustrated in FIG. 1. The value of the distance *l*, together with the electrostatic attractive force of the latent image supporting member, may affect development greatly. In particular, a residual developer liquid remaining at the raised portions *d* transfers to the imaging member and results in dirtying the background areas of the image. For this reason, in the aforementioned method in which the excess developer is removed or wiped off with a doctor blade or similar member, the wiper or scraper member *e* is made of a resilient material and in such a configuration that during wiping or scraping part of the wiper *e* is deformed to project toward the bottom of the depressions *b* of the developer liquid supply member *a* as shown in FIG. 2. To this end, the depressions *b* of the supply member *a* are formed in the form of a spiral having rigid, non-compressible raised areas or lands as illustrated in FIG. 3.

However, the use of a liquid developer supply member *a* having spiral depressions *b* for liquid developing a latent image has inherently presented a disadvantage in that, where an electrostatic latent image on the latent image supporting member *f* lies across the depression *b* as shown in FIG. 4, the developer liquid is caused to adhere merely to the portions of the latent image supporting member *f* adjacent the peaks of raised portions *d* as illustrated in FIG. 5 so that areas of the latent image placed between the raised portions *d* and above the depression *b* remain undeveloped, thereby resulting in image discontinuity as shown in FIG. 6. Furthermore, developer supply members having spiral depressions as in FIG. 3 are disadvantageous in that the flow of the developer liquid is controllable only in the direction perpendicular to that of the spiral depressions while the flow control in other directions is impossible. Therefore, the sharpness of developed image in the direction perpendicular to that of the depressions is of low quality.

Although satisfactory developed images can be obtained using the metering blades, rollers and other devices of the prior art, an alternative and improved means for preparing a liquid developer supplying device or applicator surface for coming into developing contact with an imaging surface is desirable, especially in those systems where the liquid supplying member is one having at least compressible, resilient raised areas or lands.

SUMMARY OF THE INVENTION

It is therefore an object of the present invention to overcome the foregoing disadvantages and to provide a novel liquid developer supply device and method capable of affecting excellent development which is free from image discontinuity and degradation of image sharpness.

It is another object of this invention to provide an improved apparatus and method for preparing a liquid developer supplying device or applicator for coming into developing contact with an imaging surface in those liquid development systems where the liquid developer supplying member has finely divided discrete depressions for containing liquid developer and at least compressible, resilient raised areas.

According to one aspect of the invention there is provided an improved apparatus for preparing a liquid developer applicator having lands and valleys prior to its being brought into developing contact with an imaging surface, the improved apparatus comprising a liquid developer supplying member having on the surface thereof finely divided discrete depressions for containing liquid developer and at least compressible, resilient raised areas; a non-absorbent, relatively rigid, squeegee member capable of contacting the liquid supplying member and adapted to meter the liquid developer in the supply member depressions to a predetermined level by compressing at least the compressible resilient raised areas; a cleaning means for cleaning excess liquid developer from the surface of the raised areas, said cleaning means being positioned to contact the raised areas subsequent to the contact between the squeegee member and the raised areas; and means for providing relative movement between the squeegee member and cleaning means and the applicator surface.

According to another aspect of the invention, there is provided a method for preparing a patterned liquid developer applicator having on the surface thereof finely divided discrete depressions for containing liquid developer and at least compressible, resilient raised areas, to come into developing contact with an imaging surface, said method comprising squeezing the liquid developer from the depressions of the applicator by contacting the applicator with a non-absorbent, relatively rigid squeegee member at a force sufficient to remove the liquid developer to a predetermined depth in the depressions, there being relative to motion between the applicator and the squeegee member and cleaning the surface of the raised areas by contacting the raised areas with a cleaning means, there being relative motion between the applicator and the cleaning means.

As used herein, imaging member refers to any prior art surface, such as a photoconductive surface, an interposition surface and the like.

The term "at least compressible, resilient raised areas" means that the lands must be compressible to the extent that the rigid squeegee member in contact therewith will cause a compression of at least the raised areas, however, it does not preclude the compression of the base material of which the liquid developer applicator is constructed and upon which the lands or raised areas are situated. Thus, this phrase also encompasses those liquid developer supply members where the entire member including the lands is compressible to the desired extent so that sufficient force can be applied by the rigid squeegee member consistently to remove liquid developer to a predetermined depth in the depression and/or at a predetermined distance from the peaks of the raised areas or lands.

These and other objects of this invention will become apparent to those versed in the art of electrostatic copying in view of the following detailed description of the method and apparatus taken in conjunction with the accompanying drawings in which preferred embodiments of the apparatus are shown.

DESCRIPTION OF THE PREFERRED EMBODIMENTS

Referring now to FIGS. 1–6, discussed supra, there are shown schematically and in cross-section prior art liquid developer supply members, metering apparatus, and explanatory views showing the function of such members and apparatus of the prior art.

Figure 8:
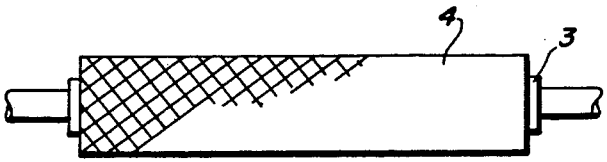
FIG. 8 is a front elevation of a preferred developer supply member employed in the device of FIG. 7.
Figure 4:
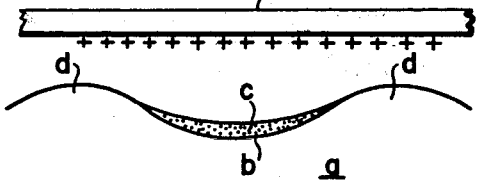
FIG. 4 is a schematic representation of one stage of development of a charged image bearing member relative to a liquid developer supply member according to the prior art.
Figure 5:
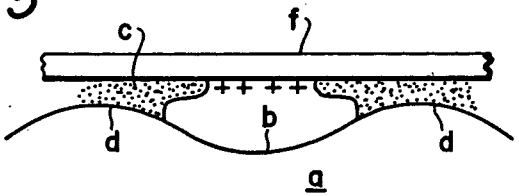
FIG. 5 is a schematic representation of another stage of development of a charged image bearing member relative to a liquid developer supply member according to the prior art.
Figure 6:
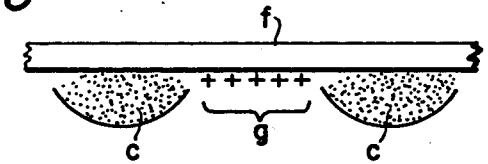
FIG. 6 is a schematic representation of a developed image bearing member according to the prior art.

Although images can be developed from liquid developer supply members (applicators) metered as shown in FIGS. 1–6, problems are sometimes encountered both in efficiently metering the valleys and cleaning the rigid lands, especially when a comparatively large amount of liquid developer has been placed on the applicator surface prior to the metering station. The prior art devices including absorbent rollers (not shown) frequently provide metering of uneven depth. An alternative means for preparing a liquid developer applicator which provides more efficient metering of the valleys and cleaning of the lands and which overcomes the uneven metering problems caused by irregularities in the applicator surface is desirable. This can be accomplished by the present invention when the liquid developer supply member or applicator is one having at least compressible, resilient raised areas or lands. Especially preferred configurations for the surface of such applicators is shown in FIGS. 8 and 9.

Figure 7:
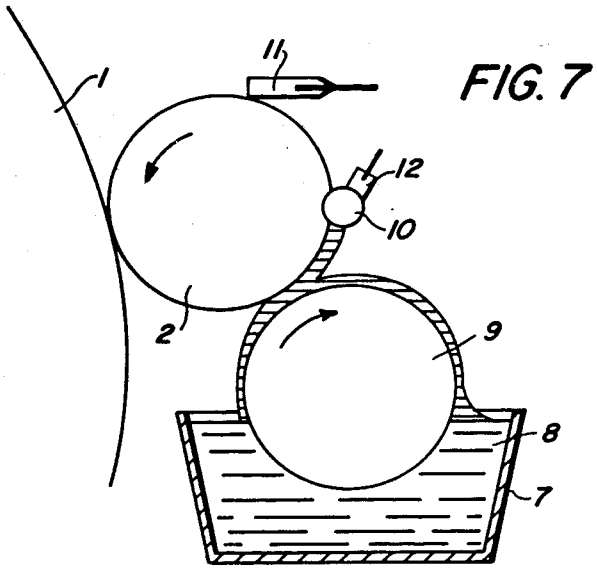
FIG. 7 is a schematic representation of an embodiment of the developer supply device according to the present invention.

A preferred embodiment of this invention will now be described with reference to the attached drawings, in which FIG. 7 is a schematic cross sectional view of the liquid developer supply device according to the present invention. In FIG. 7 there are shown a latent image supporting member 1, and a developer liquid supply member 1 rotatable in contact with the latent image supporting member 1 in the direction of the arrow. As shown in FIG. 8, the supply member 2 is formed of a metallic core roller 3 and a surrounding compressible, resilient electrically conductive material 4 of preferably about 5–10 mm in thickness. The surface of the resilient material 4 is provided with a plural number of finely divided grooves with a pitch of about 4–10 grooves per millimeter and having a depth of about 0.04 to about 0.1 millimeters. The grooves form an angle of about 45°–90° with respect to the axis of the supply member. The resilient, compressible, electrically conductive member 4, may include, for example, such materials as nitrile-butadiene rubber, polyurethane, silicone rubber, isoprene rubber, chloroprene rubber, styrene-butadiene rubber, butadiene rubber and the like. Additives maybe added to the resilient material to adjust the electrical conductivity to less than about $10^8$ ohms per centimeter by volume resistivity and to hardness of more than about 60 Shore A hardness as desired.

Figure 9:
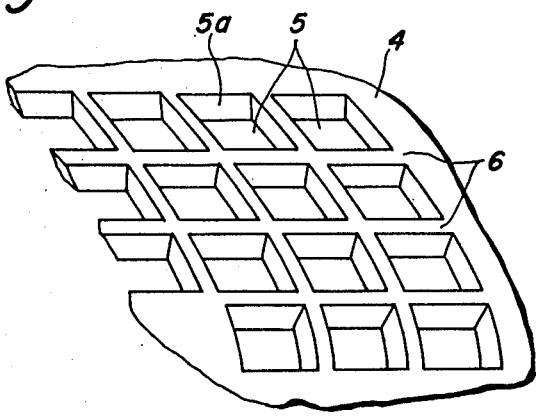
FIG. 9 is a perspective view in an enlarged scale of part of the surface of a preferred developer supply member employed in the device of FIG. 7.

In another preferred configuration the surface of the developer supply member may be provided with a plural numer of finely divided discrete depressions or valleys 5 as illustrated in FIG. 9. The depressions 5 may be formed, for example, into a square configuration enclosed with side walls 5a each of the depressions being arranged in axial rows and transversal columns crossing at a right angle to form a desired pattern. The depressions 5 are divided by raised portions 6 which are continuous with each other. These raised portions or lands must be compressible so that the desired amount of liquid developer can be metered from the depressions in accordance with the present invention.

In FIG. 7, adjacent the developer supply member 2 having the construction above described, there is provided a developer loading member or wetting roller 9, a bottom portion of which is dipped into the developer liquid 8 within a reservoir 7. The developer liquid loaded on the wetting roller 9 is then transferred to the surface of the supply member 2 as these two members 2 and 9 rotate in close proximity of each other. The developer 8 loaded on the surface of the supply member 2 is squeezed from supply member 2 by a squeegee roller 10 which compresses the lands on supply member 2, and thereby leaves a desired amount of developer liquid in the depressions or valleys. The supply member 2 is then wiped by a scraper or wiper member 11 or other equivalent means to clean developer liquid from the lands.

In a preferred embodiment, an adjusting member 12 may be provided in contact with the squeegee member 10 for controlling the surface of the squeegee member. It should be understood that, although it is preferable to provide at least one developer loading roller 9 between the reservoir 7 and the supply member 2, it is possible to arrange the developer supply member 2 in direct contact with the developer 8 within the reservoir.

Figure 1:
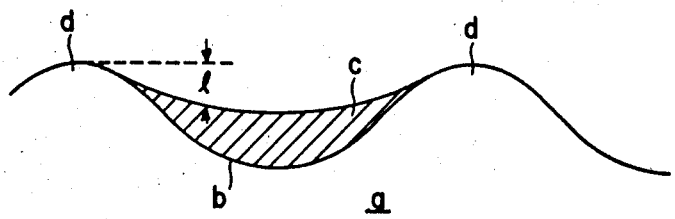
FIG. 1 is a side view of a section of a prior art liquid developer supply member for explaining the construction and function of such a device.
Figure 2:
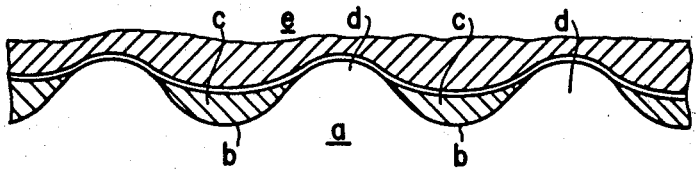
FIG. 2 is a side view of a section of a prior art liquid developer supply member showing the relationship of the member to a section of a prior art resilient doctoring device.
Figure 3:
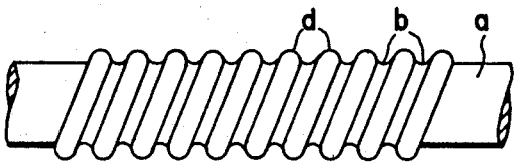
FIG. 3 is a side view of a prior art liquid developer supply member (gravure member) having a spiral pattern.
Figure 10:
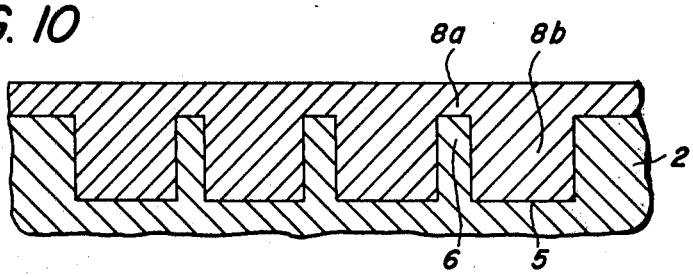
FIG. 10 is a side view of a section of a preferred developer supply member prior to metering or doctoring.
Figure 11:
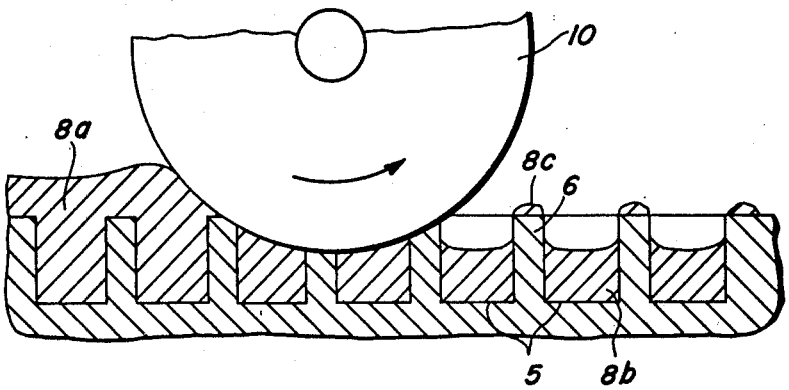
FIG. 11 is a side view of a section of a preferred developer supply member illustrating metering or doctoring with a rigid squeegee member.

The operations and function of the preferred device are as follows: first, the developer 8 is applied to the surface of the developer supply member 2 by means of loading roller 9. At this moment, there is a layer 8*a* of excess developer on the surface of the developer supply member 2 as shown in FIG. 10. As the developer supply member 2 is rotated past the squeegee roller 10, the excess developer 8*a* and part of the developer 8*b* retained within the depressions 5 are squeezed due to the temporary deformation of the surface of the supply member 2 so that a predetermined amount of developer 8*b* is left in the depressions 5 as shown in FIG. 1. The residual developer liquid 8*c* adhering to the peaks of the raised portions 6 is then removed by the scraper or wiper blade 11 or other suitable cleaning device. The resulting developer liquid 8*a* properly retained in the depressions 5 is then moved past the developing station for development of a latent image. Since the depressions 5 of the supply member 2 are enclosed in all the four direction by means of the walls of compressible raised portions 6 in the embodiment shown in the drawings, the number of flow paths is increased when compared with the conventional spiral-grooved developer supply roller. This prevents discontinuity of the developed image. Moreover, it is possible to control a flow of the developer liquid in more than two directions and hence, to prevent the degradation in the sharpness of the end areas of the obtained image.

According to the present invention, the resilient surface of the liquid developer supply member is provided with a plural number of finely divided discrete depressions and excess developer is removed by means of a squeegee member which forms a nip with the supply member and actually compresses the raised portions thereof to leave a proper amount of liquid developer in the depressions, and a scraper, wiper or absorbent member is then used to clean liquid developer from the raised areas. The risk of image discontinuity as experienced in the conventional, non-compressible, non-resilient developer supply devices employing a spirally grooved roller is eliminated and the dirtying or smudging of the background areas due to the residual developer remaining at the peaks of the raised portions is avoided. Further, since the flow of developer liquid can be controlled in more than two directions, the development of the end portions of the image can be affected advantageously without causing degradation of the sharpness of the image.

It should be understood that the form of pattern or arrangement of the depressions may be altered or varied in any suitable manner without prejudice to the function thereof, as long as there is sufficient resiliency and compressibility of the supply member or at least the lands of said supply member so that liquid developer can be squeezed from the depressions of the supply member by contacting the supply member with a non-absorbent, relatively rigid squeegee member, preferably a squeegee roller. The force applied by the squeegee member against the liquid developer supply member must be sufficient to remove the liquid developer to a predetermined depth in the depressions, for example, 0.02 mm from the surface of the raised portions. The depth of the liquid developer in the depressions depends upon various machine and material parameters and can be easily determined by one skilled in the art. Preferred cooperating supply and squeegee members may be manipulated or constructed so that liquid developer may be metered in the depressions to within about 0.01 mm from the surface of the lands to within about 0.01 mm from the lowest portion of the depressions or valleys.

Thus, any suitable applicator surface may be used which will be useful in accordance with the liquid development method disclosed in U.S. Pat. No. 3,084,043 or U.S. Pat. No. 3,806,354, both incorporated herein by reference, as long as the applicator surface has the desired resilience and compressibility as described herein.

Gundlach in U.S. Pat. No. 3,084,043 discloses and claims a liquid development system wherein liquid developer from a reservoir is deposited on a gravure roll and fills the depressions in the roller surface. The gravure roller is doctored to remove excess developer therefrom, and as a receiving surface charged in image configuration passes against the gravure roller, the liquid developer is attracted from the depressions in image configuration by the charge. Amidon et al. in U.S. Pat. No. 3,806,354 discloses an electrostatographic imaging system wherein an electrostatic latent image is developed by placing the imaging surface in developing configuration with a patterned applicator surface having a substantially uniform distribution of raised portions or "lands" and depressed portions or "valleys" and containing a relatively non-conductive liquid developer in the depressed portions thereof while the raised portions are substantially free of developer. Amidon et al claim a method of cyclically developing electrostatic latent images on a reusable electrostatographic imaging surface comprising the steps of forming an electrostatic latent image on the resuable imaging surface, providing an applicator having a substantially uniform pattern of raised portions and depressed portions, said depressed portions containing developing quantities of an electrically non-conductive liquid developer having a bulk resistivity of from about $10^{10}$ ohm cm to about $10^{14}$ ohm cm while said raised portions are substantially free of liquid developer, positioning said applicator adjacent said imaging surface so as to induce equal and opposite charges in the liquid developer in regions corresponding to those areas of the imaging surface intended to be developed, such that the liquid developer is electrostatically pulled from the applicator to the imaging surface in image configuration, transferring said liquid developer from said imaging surface to a receiving surface, preparing said reusable imaging surface for the next imaging sequence repeating the steps of forming, providing, positioning and transferring at least one additional time whereby residues of said non-conductive liquid developer remaining on the imaging surface are not damaging to cyclical use of the imaging surface.

Typically, the applicator is a roller having a pattern of raised portions "lands" on its surfaces with recesses "valleys" therebetween said valleys adapted to contain liquid developer. In a preferred embodiment the valleys are a pattern of helically wound grooves. Other suitable applicator surface patterns are described in U.S. Pat. No. 3,772,012 where typical applicator surfaces include among others, patterned webs or belts, and cylindrical rolls having surface patterns such as single screw-cuts or trihelicoid, pyramidal or quadragravure indentations.

In an especially preferred embodiment of the present invention the surface of the liquid developer supply member, or at least the raised areas or lands thereof, has a hardness of more than 60 Shore A, and the hardness of the surface of the squeegee member is greater than the hardness of the surface of the supply member or at least the raised areas or lands thereof. In these modes, the cooperating squeegee member and liquid developer supply member, may form a nip at a force sufficient to compress the raised areas up to about 95 percent of their original elevations and preferably from about 0.05 percent to about 50 percent of their original elevation. The maximum force applied to any such member must be no greater than the force which compresses the lands to the extent that they remain compressed, deformed or otherwise rendered unsuitable for developing electrostatic latent images on an imaging member.

The land cleaning means may be formed from any suitable material. Typically, the land cleaning means may be an abosrbent roller, an absorbent blade or a resilient blade, for example, a hard plastic blade, sufficient to remove liquid developer from the surface of the lands or raised areas.

The instant liquid developer supply device and method may be used in most xerographic systems where liquid developers are applied to imaging members from a patterned liquid developer applicator. Exemplary of such a system is a xerographic member which may be photoconductive selenium coated on a conductive drum. In operation, the xerographic member is charged in the dark to a uniform electrostatic potential by a charging device such as a source of corona. Alternatively, the xerographic member may be charged, for example, by friction contact. The charged member is then exposed to a light image at an exposure station. The charged surface, being photoconductive, when exposed to light to which it is responsive, will become conductive in light struck areas allowing the surface charge to move through to the conductive drum leaving a pattern of charge on the surface of drum corresponding to the non-light struck areas. The charge pattern thus formed is then made visible at a developing station where liquid developer is applied to the photoconductive surface. The developing station is a liquid developer applicator surface having a surface pattern of lands and valleys supplied with a liquid developer from a liquid developer reservoir. According to the present invention, the resilient, compressible applicator surface is then prepared to come into developing contact with the imaging surface by first contacting it with a squeegee member and a cleaning member so that the lands of the applicator surface are substantially free from liquid developer and the valleys contain a metered amount of developer. The liquid developer is then brought into a developing relationship with the xerographic member so that the liquid developer is deposited on the charged areas in accordance with the teachings of U.S. Pat. No. 3,084,043. The image, now visible, may be transferred to a receiver member at a transfer station. The receiver member may be, for example, paper entrained over a roller and pressed into contact with the toner image. The developer is thus transferred to the receiver member forming the final copy.

The instant invention described in FIGS. 7–11 is suitable to prepare an applicator surface to come into developing contact with an imaging surface. Prints developed by an applicator which has been so prepared show substantially uniform density and a desirably low amount of developer in the background areas of the image.

While particular embodiments of the invention are described above, it will be appreciated that various modifications may be made by one skilled in the art without departing from the scope of the invention as defined in the appended claims.

What is claimed is:

1. An improved liquid developer supplying device for applying liquid developer to an image bearing member comprising a developer liquid supplying member having on the surface thereof finely divided discrete depressions for containing liquid developer and at least compressible, resilient raised areas; a non-absorbent, relatively rigid, squeegee member capable of contacting the liquid supplying member and adapted to meter the liquid developer in the supply member depressions to a predetermined level by compressing the compressible, resilient raised areas; a cleaning means for cleaning excess liquid developer from the surface of the raised areas, said cleaning means being positioned to contact the raised areas subsequent to the contact between the squeegee member and the raised areas; and means for providing relative movement between the squeegee member and cleaning means and the applicator surface.

2. The apparatus of claim 1 wherein at least the raised areas on the surface of the liquid supplying member have a hardness of more than 60 Shore A.

3. The apparatus of claim 1 wherein the hardness of the surface of the squeegee member is greater than the hardness of at least the raised areas on the surface of the liquid supplying member.

4. The apparatus of claim 1 wherein the liquid supplying member comprises a metallic core roller and a resilient, electrically conductive coating of about 5 to 10 mm thickness thereon and having depressions for containing liquid developer therein, the depressions having a depth of about 0.04 to about 0.0 mm.

5. The apparatus of claim 1 wherein the relatively rigid, non-abosrbent squeegee member contacts the liquid supplying member with a force sufficient to compress the raised areas up to about 95 percent of their original elevation.

6. The apparatus of claim 1 wherein the relatively rigid, non-absorbent squeegee member surface contacts the liquid supplying member with a force sufficient to compress the raised areas from about 0.05 percent to about 50 percent of their original elevation.

7. The apparatus of claim 1 wherein the entire surface of the liquid supplying member is compressible and resilient.

8. The apparatus of claim 1 wherein the cleaning means is an absorbent roller.

9. The apparatus of claim 1 wherein the cleaning means is an absorbent cleaning blade.

10. The apparatus of claim 1 wherein the cleaning means is a resilient cleaning blade.

11. A method for preparing a patterned liquid developer applicator having on the surface thereof finely divided discrete depressions for containing liquid developer and at least compressible, resilient raised areas, to come into contact with an imaging surface, said method comprising squeezing the liquid developer from the depressions of the applicator by contacting the applicator with a non-absorbent, relatively rigid squeegee member at a force sufficient to remove the liquid developer to a predetermined depth in the depressions, there being relative motion between the applicator and the squeegee member and cleaning the surface of the raised areas by contacting the raised areas with a cleaning means, there being relative motion between the applicator and the cleaning means.

12. The method of claim 11 wherein the relatively rigid, non-absorbent squeegee member contacts the applicator at a force sufficient to compress the raised areas up to about 95 percent of their original elevation.

13. The method of claim 11 wherein the relatively rigid, non-absorbent squeegee member surface contacts the applicator with a force sufficient to compress the raised areas from about 0.05 percent to about 50 percent of their original elevation.

* * * * *

UNITED STATES PATENT AND TRADEMARK OFFICE

CERTIFICATE OF CORRECTION

PATENT NO. : 4,024,838
DATED : May 24, 1977
INVENTOR(S) : Kiyoshi Horie

It is certified that error appears in the above-identified patent and that said Letters Patent are hereby corrected as shown below:

Column 9, line 34, delete "0.0" and insert --0.1--.

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*